US008528515B2

(12) United States Patent
Oshita et al.

(10) Patent No.: US 8,528,515 B2
(45) Date of Patent: Sep. 10, 2013

(54) CRANKCASE OF INTERNAL COMBUSTION ENGINE

(75) Inventors: Toru Oshita, Saitama (JP); Katsuhiro Kunikiyo, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 233 days.

(21) Appl. No.: 12/788,927

(22) Filed: May 27, 2010

(65) Prior Publication Data

US 2010/0319649 A1 Dec. 23, 2010

(30) Foreign Application Priority Data

Jun. 19, 2009 (JP) ..... 2009-146382

(51) Int. Cl.
*F02B 75/22* (2006.01)
*F02F 7/00* (2006.01)
*F01M 1/02* (2006.01)

(52) U.S. Cl.
USPC ..... 123/195 R; 123/195 C; 123/196 R

(58) Field of Classification Search
USPC ..... 123/41.85, 195 R, 41.69, 193.1, 123/149 R, 149 D, 196 R, 196 A, 198 C, 123/196 W, 196 AB, 195 C; 384/457, 433; 285/349; 92/73; 440/88 L; 29/888.01
IPC ..... F02F 1/00,7/00
See application file for complete search history.

(56) References Cited

U.S. PATENT DOCUMENTS

| | | | | |
|---|---|---|---|---|
| 4,955,343 | A * | 9/1990 | Ogami | 123/195 R |
| 5,975,970 | A | 11/1999 | Daikoku | |
| 6,616,836 | B1 | 9/2003 | Covington | |
| 7,171,939 | B1 * | 2/2007 | Tiller | 123/196 R |
| 2007/0199524 | A1 | 8/2007 | Nagahashi et al. | |
| 2010/0006057 | A1 * | 1/2010 | Mendler | 123/196 R |

FOREIGN PATENT DOCUMENTS

| | | | |
|---|---|---|---|
| EP | 0553069 | A1 | 7/1993 |
| JP | 3-15626 | A | 1/1991 |
| JP | 5-65851 | A | 3/1993 |
| JP | 08144844 | A * | 6/1996 |
| JP | 10-220213 | A | 8/1998 |
| JP | 2004-308519 | A | 11/2004 |
| JP | 2007-231787 | A | 9/2007 |

* cited by examiner

*Primary Examiner* — Noah Kamen
(74) *Attorney, Agent, or Firm* — Birch, Stewart, Kolasch & Birch, LLP

(57) ABSTRACT

A crankcase of an internal combustion engine with a reduced size for an oil pan. A crankcase is composed of an upper crankcase half and a lower crankcase half. A wall portion for defining a space X as a flow passage for a lubricating oil is formed below a journal bolt mounting surface of the lower crankcase half. A tool insertion hole for insertion of a tool for tightening a journal bolt is formed through the wall portion.

20 Claims, 6 Drawing Sheets

CRANKCASE OF INTERNAL COMBUSTION ENGINE

CROSS-REFERENCE TO RELATED APPLICATIONS

The present application claims priority under 35 USC 119 to Japanese Patent Application No. 2009-146382 filed on Jun. 19, 2009 the entire contents of which are hereby incorporated by reference.

BACKGROUND OF THE INVENTION

1. Field of the Invention

The present invention relates to a crankcase of an internal combustion engine.

2. Description of Background Art

An internal combustion engine is known that includes a crankcase composed of an upper crankcase half and a lower crankcase half. In this kind of crankcase, the upper crankcase half and the lower crankcase half respectively have an upper journal support wall and a lower journal support wall for cooperatively supporting a crank journal of a crankshaft. The upper journal wall and the lower journal wall are fastened together by a journal bolt mounted from the lower surface of the crankcase. See, for example, Japanese Patent Laid-open No. 2004-308519.

In the above-mentioned internal combustion engine, lubricating oil (engine oil) is supplied from an oil pump to a cylinder portion, for example, and returned from one lateral side of the crankcase to an oil pan located below the crankcase.

However, in the case that the lubricating oil from the one lateral side of the crankcase is passed through a portion of the crankcase laterally outside of the journal support wall and the journal bolt and returned to the oil pan, the width of the oil pan must be increased to cause an increase in size of the oil pan.

SUMMARY AND OBJECTS OF THE INVENTION

It is accordingly an object of an embodiment of the present invention to provide a crankcase of an internal combustion engine which can reduce the size of an oil pan.

In accordance with an embodiment of the present invention, there is provided a crankcase of an internal combustion engine that includes an upper crankcase half and a lower crankcase half, the upper crankcase half and the lower crankcase half respectively having an upper journal support wall and a lower journal support wall for cooperatively supporting a crank journal of a crankshaft with the upper journal support wall and the lower journal support wall being fastened together by a journal bolt mounted from the lower side of the crankcase. A wall portion for defining a space as a flow passage for a lubricating oil is formed below a journal bolt mounting surface of the lower crankcase half for mounting the journal bolt. A tool insertion hole for insertion of a tool for tightening the journal bolt is formed through the wall portion.

According to an embodiment of the present invention, the wall portion for defining the space as a lubricating oil passage is formed below the journal bolt mounting surface of the lower crankcase half, and the tool insertion hole for insertion of the tool for tightening the journal bolt is formed through the wall portion. Accordingly, the journal bolt can be mounted from the lower side of the crankcase, and the lubricating oil passage can be formed below the journal bolt mounting surface. This lubricating oil passage is located laterally inside of one side surface of the crankcase, so that the width of an oil pan to which the oil from the lubricating oil passage is returned can be reduced to thereby reduce the size of the oil pan. As a result, an increase in weight due to an increase in size of the oil pan can be prevented.

Further, since the lubricating oil passage is formed below the journal bolt mounting surface, it is possible to prevent an increase in friction due to the case that the lubricating oil passage bypasses the journal support wall and the journal bolt.

The wall portion may be located laterally outside of an oil pan of the internal combustion engine and the wall portion is formed with an exit oil passage for discharging the lubricating oil from the space toward the oil pan. With this configuration, the lubricating oil from the space defined by the wall portion can be smoothly returned through the exit oil passage toward the oil pan.

In addition, the space defined by the wall portion may open to one lateral side of the lower crankcase half, a side cover may be connected to the one lateral side of the lower crankcase half and the lubricating oil may be returned from the side cover flows into the space through its side opening. With this configuration, the size of the oil pan can be sufficiently reduced in relation to the configuration for returning the lubricating oil from the side cover to the oil pan.

Further, the wall portion may include a detachable oil filter. With this configuration, the journal bolt can be mounted from the lower side of the crankcase, and the lubricating oil passage may be formed below the journal bolt mounting surface. Furthermore, the tool insertion hole below the journal bolt mounting surface can be closed by the oil filter. Accordingly, the lubricating oil passage passing through the oil filter can be formed without bypassing the journal support wall and the journal bolt. As a result, a friction can be reduced and it is unnecessary to avoid the mounting position of the journal bolt in mounting the oil filter.

According to an embodiment of the present invention, the wall portion for defining the space as a lubricating oil passage is formed below the journal bolt mounting surface of the lower crankcase half, and the tool insertion hole for insertion of the tool for tightening the journal bolt is formed through the wall portion. Accordingly, the oil pan to which the oil from the space is returned can be reduced in size.

Further, the wall portion is located laterally outside of the oil pan, and the wall portion is formed with the exit oil passage for discharging the lubricating oil from the space toward the oil pan. Accordingly, the lubricating oil from the space can be smoothly returned through the exit oil passage toward the oil pan.

Further, the space defined by the wall portion opens to one lateral side of the lower crankcase half, and the side cover is connected to the one lateral side of the lower crankcase half, wherein the lubricating oil returned from the side cover flows into the space through its side opening. Accordingly, the size of the oil pan can be sufficiently reduced in relation to the configuration for returning the lubricating oil from the side cover to the oil pan.

Further, the wall portion includes the detachable oil filter. Accordingly, the lubricating oil passage passing through the oil filter can be formed without bypassing the journal support wall and the journal bolt. As a result, friction can be reduced and it is unnecessary to avoid the mounting position of the journal bolt in mounting the oil filter.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
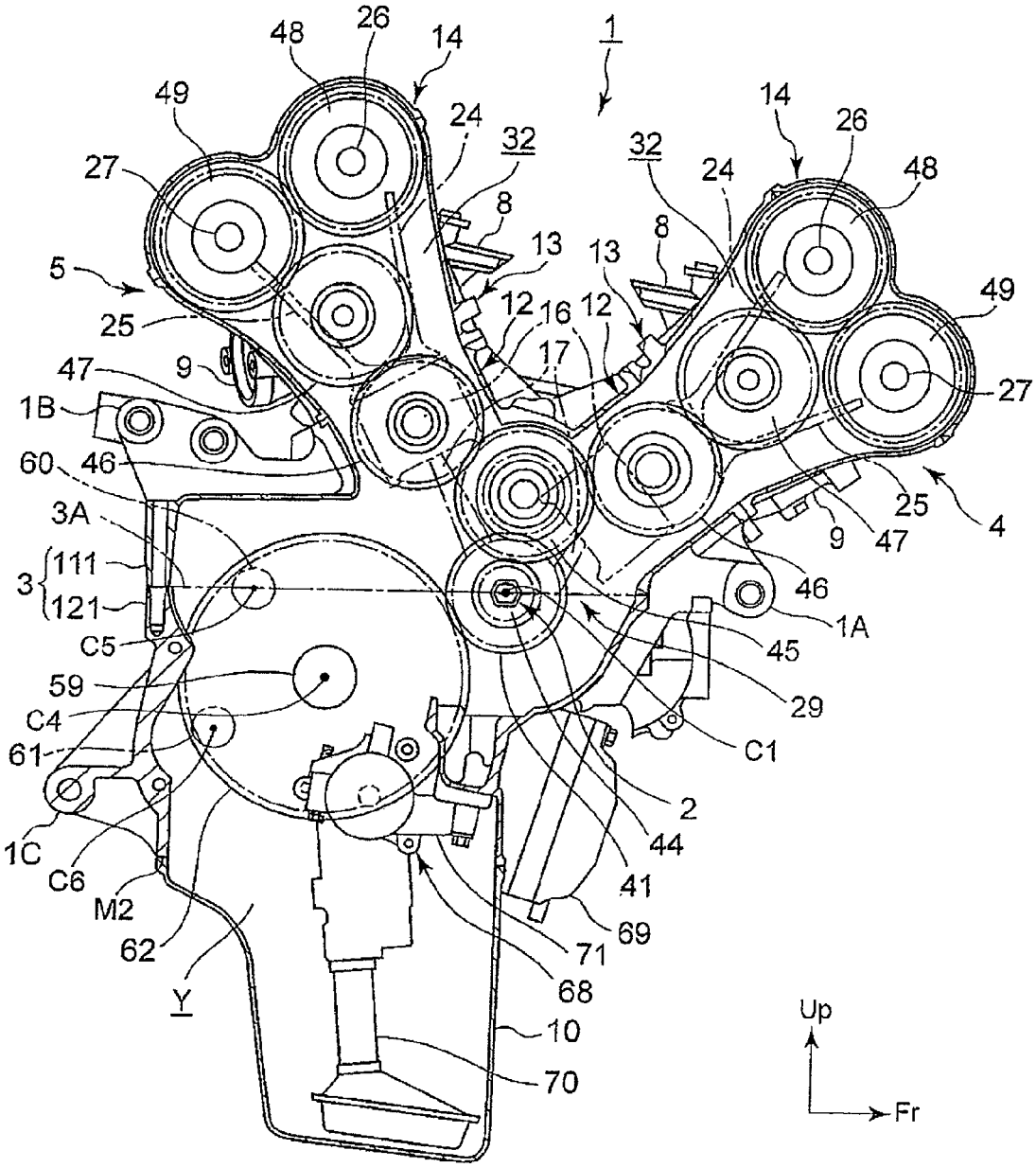
FIG. 1 is a right side view of an engine to which a preferred embodiment of the present invention is applied.

A preferred embodiment of the present invention will now be described with reference to the attached drawings.

In the following description, the terms in relation to directions, such as front, rear, right, left, upper, and lower are the same as those with respect to a vehicle to which the present invention is applied unless otherwise specified. Further, in the drawings, the arrow Fr denotes the front side of the vehicle, the arrow R denotes the right side of the vehicle, and the arrow Up denotes the upper side of the vehicle.

FIG. 1 is a right side view of an engine 1 to which a preferred embodiment of the present invention is applied.

The engine (which is referred to also as an internal combustion engine) 1 is a water-cooled, four-stroke, V-type, four-cylinder engine. For example, the engine 1 is mounted on a vehicle body of a motorcycle as a prime mover thereof in such a manner that the rotation center C1 of a crankshaft 2 extends in a direction (lateral direction) perpendicular to the traveling direction of the vehicle.

The engine 1 has a crankcase 3. A front bank 4 is provided at a front upper portion of the crankcase 3 so as to be inclined to the front side of the vehicle, and a rear bank 5 is provided just behind the front bank 4 so as to be inclined to the rear side of the vehicle. The crankshaft 2 is provided in a front portion of the crankcase 3, and a transmission (not shown) is accommodated in a rear portion of the crankcase 3.

A plurality of intake pipe mounting portions 8 connected to a throttle body (not shown) are provided on the rear surface of the front bank 4 and on the front surface of the rear bank 5. A plurality of exhaust pipe mounting portions 9 connected to an exhaust pipe (not shown) are provided on the front surface of the front bank 4 and on the rear surface of the rear bank 5. An oil pan 10 is mounted on the lower side of the crankcase 3.

Each of the front and rear banks 4 and 5 includes a cylinder body 12 formed integrally with the front upper portion of the crankcase 3, a cylinder head 13 mounted on the upper end of the cylinder body 12, and a head cover 14 mounted on the upper end of the cylinder head 13. Further, a piston 16 is reciprocatably fitted in a cylinder bore (not shown) formed in each cylinder body 12.

In FIG. 1, a front engine mount 1A, a rear upper engine mount 1B, and a rear lower engine mount 1C are integral with the crankcase 3.

Figure 2:
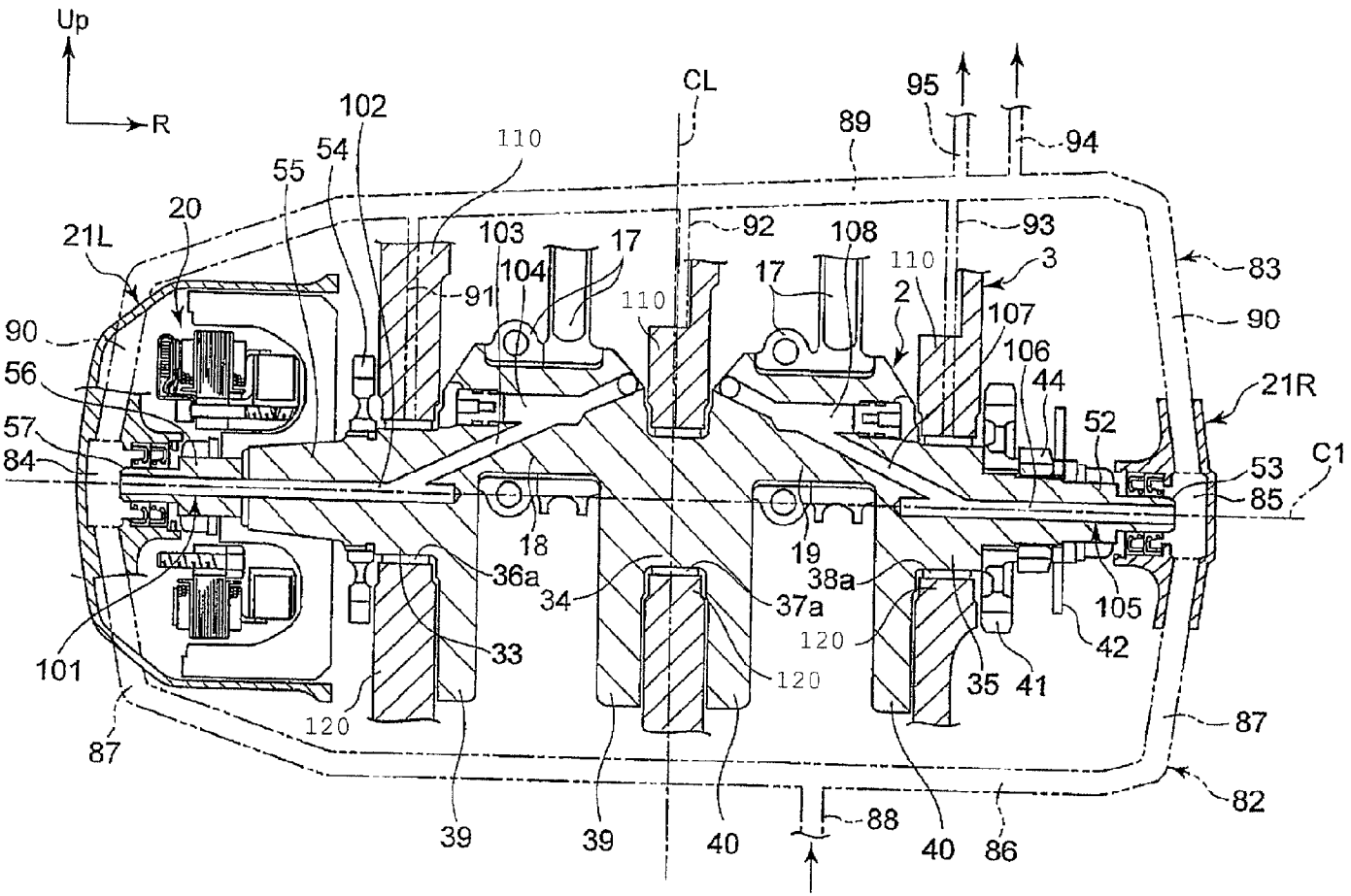
FIG. 2 is a sectional view showing the internal configuration of the engine.

FIG. 2 is a sectional view showing the internal configuration of the engine 1.

A connecting rod 17 is pivotably connected at its small end to each piston 16 (see FIG. 1). The big end of each connecting rod 17 is rotatably connected to a pair of left and right crankpins 18 and 19 of the crankshaft 2. In FIG. 2, reference symbol CL denotes the lateral center of the engine 1.

The crankshaft 2 has the pair of left and right crankpins 18 and 19. The two connecting rods 17 in the left two cylinders of the front and rear banks 4 and 5 are connected to the left crankpin 18, and the two connecting rods 17 in the right two cylinders of the front and rear banks 4 and 5 are connected to the right crankpin 19. Further, a generator 20 is coaxially provided at the left end of the crankshaft 2. The generator 20 is covered with a crankcase side cover (which is referred to also as a generator cover) 21L connected to the left side of the crankcase 3.

Each cylinder head 13 (see FIG. 1) closes the upper opening of each cylinder bore to form a combustion chamber in cooperation with each piston 16. In this preferred embodiment, the engine 1 is of a DOHC four-valve type such that the ceiling portion of each combustion chamber is formed with two intake openings of an intake port and two exhaust openings of an exhaust port, wherein the two intake openings are operatively closed by two intake valves 24 for each cylinder and the two exhaust openings are operatively closed by two exhaust valves 25 for each cylinder.

The stem (shaft portion) of each intake valve 24 and the stem of each exhaust valve 25 extend toward the upper end of each cylinder head 13 so as to form a V-shape as viewed in side elevation. The upper end of the stem of each intake valve 24 is in sliding contact with each cam of an intake camshaft 26 through a valve lifter (not shown). Similarly, the upper end of the stem of each exhaust valve 25 is in sliding contact with each cam of an exhaust camshaft 27 through a valve lifter (not shown). These camshafts 26 and 27 extend parallel to the crankshaft 2 (in the lateral direction of the vehicle). The rotation of the camshafts 26 and 27 causes the reciprocation of the valves 24 and 25 along their stems, thereby operatively closing the openings of the intake and exhaust ports exposed to the combustion chambers. A valve operating mechanism including these valves 24 and 25 and the camshafts 26 and 27 as main components is accommodated in a valve operating chamber formed by the cylinder head 13 and the head cover 14 in each of the front and rear banks 4 and 5.

A cam gear train mechanism (which is referred to also as a gear type timing mechanism) 29 is provided on the right side of the front and rear banks 4 and 5. The camshafts 26 and 27 cooperate with the crankshaft 2 through the cam gear train mechanism 29 to thereby operate the intake and exhaust valves 24 and 25. The cam gear train mechanism 29 is accommodated in a gear train chamber (timing chamber) 32 formed in each right portion of the front and rear banks 4 and 5. Each gear train chamber 32 functions also as a return passage for engine oil (lubricating oil) supplied to each valve operating chamber.

As shown in FIG. 2, the crankshaft 2 has three crank journals 33, 34, and 35 at left, central, and right portions, respectively. Three pairs of upper and lower journal support walls 110 and 120 are formed in the crankcase 3, so as to support the three crank journals 33, 34, and 35. Thus, the three crank journals 33, 34, and 35 are rotatably supported through three metal bearings 36*a*, 37*a*, and 38*a* to the three pairs of upper and lower journal support walls 110 and 120, respectively.

The left crankpin 18 is supported through a pair of left crank webs (crank arms) 39 between the left and central crank journals 33 and 34. Similarly, the right crankpin 19 is supported through a pair of right crank webs 40 between the central and right crank journals 34 and 35.

A primary drive gear 41 is coaxially provided on a right end portion of the crankshaft 2 adjacent to the right side of the right journal 35, and a cam drive gear 44 is coaxially provided on the right end portion of the crankshaft 2 adjacent to the right side of the primary drive gear 41. Further, a pulser rotor 42 is coaxially provided on the right end portion of the crankshaft 2 adjacent to the right side of the cam drive gear 44.

The cam drive gear 44 constitutes a part of the cam gear train mechanism 29. As shown in FIG. 1, a rotational drive force from the cam drive gear 44 is transmitted to a single second gear (idle gear) 45 located above the cam drive gear 44. Thereafter, the rotational drive force from the second gear 45 is dividedly transmitted to a pair of front and rear third gears (idle gears) 46 located on the right side of the cylinder bodies 12 of the front and rear banks 4 and 5. Thereafter, the rotational drive forces from the front and rear third gears 46 are respectively transmitted to a pair of front and rear fourth gears (idle gears) 47 located on the right side of the cylinder heads 13 of the front and rear banks 4 and 5. Thereafter, the rotational drive forces from the front and rear fourth gears 47 are respectively transmitted to an intake cam drive gear 48 in the front bank 4 and an exhaust cam drive gear 49 in the rear bank 5. In each of the front and rear banks 4 and 5, the intake and exhaust cam drive gears 48 and 49 are coaxially fixed to the right end portions of the intake and exhaust camshafts 26 and 27, respectively, in the condition where these gears 48 and 49 are in mesh with each other.

Thus, the second gear 45, the third gears 46, and the fourth gears 47 constitute idle gears for transmitting the rotational drive force from the cam drive gear 44 to the cam driven gears 48 and 49 in the front and rear banks 4 and 5. Accordingly, the rotation of the cam drive gear 44 rotating with the crankshaft 2 is accurately transmitted through the plurality of idle gears 45, 46, and 47 to the camshafts 26 and 27 in the front and rear banks 4 and 5.

In the cam gear train mechanism 29, the camshafts 26 and 27 are rotated 360° by 720° rotating the crankshaft 2 (i.e., the cam drive gear 44), and the ratio in number of gear teeth between the cam drive gear 44 and the second gear (idle gear) 45 is set to 1:2, thereby obtaining the above rotational speed ratio.

As shown in FIG. 2, an externally threaded portion 52 is formed at the right end portion of the crankshaft 2 adjacent to the right side of the pulser rotor 42. The externally threaded portion 52 is adapted to threadly engage a nut for fixing the pulser rotor 42, the cam drive gear 44, and the primary drive gear 41. Further, a cylindrical portion 53 smaller in diameter than the externally threaded portion 52 is formed at the right end portion of the crankshaft 2 adjacent to the right side of the externally threaded portion 52.

The outer side (right side) of the cylindrical portion 53 in the lateral direction of the engine 1 is covered with a crankcase side cover 21R connected to the right side of the crankcase 3.

That is, the engine 1 has such a configuration that the left and right crankcase side covers 21L and 21R are respectively connected to the left and right sides of the crankcase 3.

A left balancer drive gear 54 is coaxially provided on the left end portion of the crankshaft 2 adjacent to the left side of the left crank journal 33. The left balancer drive gear 54 functions as a drive gear for driving a left balancer (not shown) provided in a front left portion of the crankcase 3.

The left end portion of the crankshaft 2 adjacent to the left side of the left balancer drive gear 54 is formed as a tapered portion 55 tapered toward the left end of the crankshaft 2. For example, an outer rotor of the generator 20 is fixedly engaged with the tapered portion 55. An externally threaded portion 56 is formed at the left end portion of the crankshaft 2 adjacent to the left side of the tapered portion 55. The externally threaded portion 56 is adapted to threadly engage a nut for fixing the generator 20. Further, a cylindrical portion 57 smaller in diameter than the externally threaded portion 56 is formed at the left end portion of the crankshaft 2 adjacent to the externally threaded portion 56.

As shown in FIG. 1, a main shaft 59, a counter shaft 60, and an output shaft 61 are rotatably supported to the rear portion of the crankshaft 3 so as to extend in the lateral direction of the vehicle. In FIG. 1, reference symbols C4, C5, and C6 denote the rotation centers of the main shaft 59, the counter shaft 60, and the output shaft 61, respectively. The main shaft 59 and the counter shaft 60 are shaft members for supporting shift gears in the transmission.

A primary driven gear 62 having a relatively large diameter is coaxially provided on a right end portion of the main shaft 59 so as to be rotatable relative to the main shaft 59. The primary driven gear 62 is in mesh with the primary drive gear 41 (see FIG. 2). Accordingly, the rotational drive force of the crankshaft 2 is transmitted through the primary drive gear 41, the primary driven gear 62, and a clutch mechanism (not shown) to the main shaft 59.

The primary drive gear 41 functions also as a drive gear for driving a right balancer (not shown) provided in a front right portion of the crankcase 3.

An oil pump 68 for feeding the engine oil to oil passages (lubricating oil passages) in the engine 1 is provided in a lower portion of the crankcase 3. The oil pump 68 is operatively connected through a chain to a pump drive sprocket (not shown) coaxially fixed to the main shaft 59, so that the oil pump 68 is operated by the rotation of the crankshaft 2. An oil strainer 70 extends downwardly from the lower portion of the oil pump 68 toward the oil pan 10. Further, a discharge passage 71 extends from the front portion of the oil pump 68 toward an oil filter 69 provided on the front side of the lower portion of the crankcase 3. In the following description, the engine oil will be referred to simply as oil.

During operation of the engine 1, the oil pump 68 is operated to suck the oil stored in the oil pan 10 through the oil strainer 70. The oil is next discharged through the discharge passage 71 to the oil filter 69 and next fed to various portions to be lubricated in the engine 1. The oil used for lubrication in the engine 1 is returned to the oil pan 10 and fed again by the oil pump 68, thus circulating in the engine 1.

FIG. 2 shows a part of the oil passages in the engine 1. As shown in FIG. 2, an entrance oil passage 82 is provided in the lower portion of the crankcase 3 so as to span the length of the crankshaft 2. An exit oil passage 83 is provided in the front upper portion of the crankcase 3 so as to span the length of the crankshaft 2.

The oil passages 82 and 83 extend in the left and right side walls of the crankcase 3, i.e., in the left and right crankcase side covers 21L and 21R to form tunnel-shaped passages, which are connected to left and right shaft end oil chambers 84 and 85 adjacent to the left and right ends of the crankshaft 2.

The entrance oil passage 82 has a horizontal passage 86 extending below the crankshaft 2 over substantially the same length thereof in the lateral direction of the vehicle and a pair of vertical passages 87 extending upwardly from the opposite ends of the horizontal passage 86. That is, the entrance oil passage 82 has a substantially U-shaped configuration opening to the upper side as viewed in FIG. 2. A guide passage 88 extending from the oil filter 69 is connected to a right portion of the horizontal passage 86. In FIG. 2, the arrows denote the flow of the oil.

The exit oil passage 83 has a horizontal passage 89 extending above the crankshaft 2 (between the lower end portions of the front and rear banks 4 and 5) over substantially the same length thereof in the lateral direction of the vehicle and a pair of vertical passages 90 extending downwardly from the opposite ends of the horizontal passage 89. That is, the exit oil passage 83 has a substantially inverted U-shaped configuration opening to the lower side as viewed in FIG. 2. The oil passages 82 and 83 communicate with each other through the shaft end oil chambers 84 and 85 to thereby form a loop oil passage surrounding the crankshaft 2 as viewed in FIG. 2.

Left, central, and right bearing oil passages 91, 92, and 93 respectively extend from left, central, and right portions of the horizontal passage 89 of the exit oil passage 83 toward the left, central, and right upper journal support walls 110. Further, a pair of front and rear bank oil passages 94 and 95 extend upwardly from the right portion of the horizontal passage 89 of the exit oil passage 83 along the front and rear banks 4 and 5, respectively.

When the oil pump 68 is operated during running of the engine 1, the oil is first fed into the entrance oil passage 82 and once supplied into the shaft end oil chambers 84 and 85. Thereafter, the oil is supplied through left and right axial oil passages 101 and 105 to the left and right crankpins 18 and 19, respectively, and also supplied through the exit oil passage 83 and the bearing oil passages 91, 92, and 93 to the metal bearings 36*a*, 37*a*, and 38*a*, respectively.

Further, a part of the oil in the exit oil passage 83 is supplied through the front and rear bank oil passages 94 and 95 to the valve operating chambers in the front and rear banks 4 and 5, respectively.

The left axial oil passage 101 is formed in the left portion of the crankshaft 2 so as to extend in the axial direction thereof. The left end of the left axial oil passage 101 is connected to the left shaft end oil chamber 84, and the right end portion of the left axial oil chamber 101 is connected through oil passages 103 and 104 to the left crankpin 18, thereby supplying the oil to the sliding surfaces of the left connecting rods 17.

Similarly, the right axial oil passage 105 is formed in the right portion of the crankshaft 2 so as to extend in the axial direction thereof. The right end of the right axial oil passage 105 is connected to the right shaft end oil chamber 85, and the left end portion of the right axial oil passage 105 is connected through oil passages 107 and 108 to the right crankpin 19, thereby supplying the oil to the sliding surfaces of the right connecting rods 17.

The crankcase 3 is composed of a pair of upper and lower cases that can be separated from each other. That is, the crankcase 3 is composed of an upper crankcase half 111 as the upper case and a lower crankcase half 121 as the lower case. The upper crankcase half 111 has the upper journal support walls 110 for supporting the upper halves of the crank journals 33, 34, and 35 of the crankshaft 2. Similarly, the lower crankcase half 121 has the lower journal support walls 120 for supporting the lower halves of the crank journals 33, 34, and 35 of the crankshaft 2.

In FIG. 1, a mating surface 3A is provided between the upper crankcase half 111 and the lower crankcase half 121 (which is referred to also as a split surface of the crankcase 3).

Figure 3:
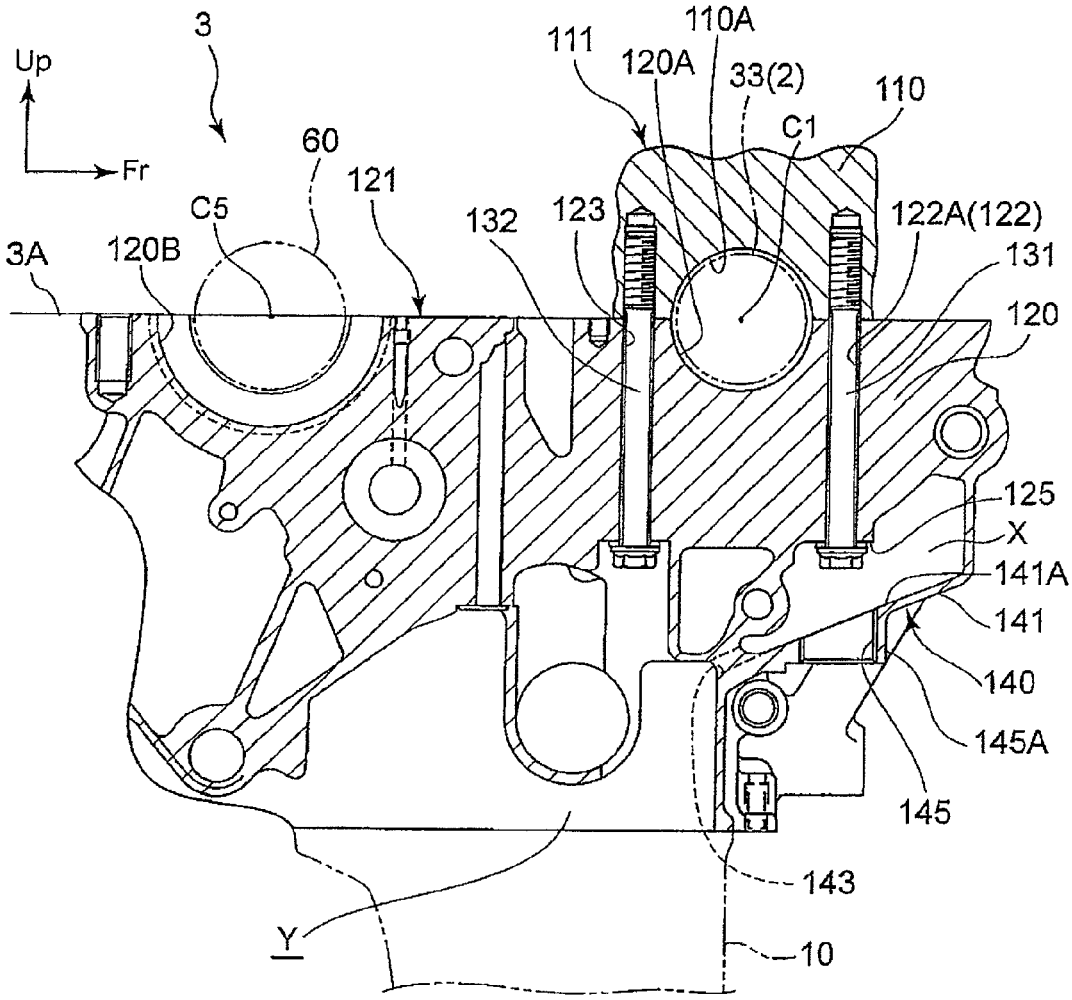
FIG. 3 is a sectional side view showing a supporting structure for a crankshaft and its peripheral configuration.

FIG. 3 is a sectional side view showing a supporting structure for the crankshaft 2 and its peripheral configuration. As shown in FIG. 3, the left crank journal 33 of the crankshaft 2 is supported to the upper journal support wall 110 and the lower journal support wall 120 at the left portion of the crankcase 3. More specifically, the upper journal support wall 110 is formed with a semicircular recess 110A corresponding to the outer circumference of the upper half of the crank journal 33, and the lower journal support wall 120 is formed with a semicircular recess 120A corresponding to the outer circumference of the lower half of the crank journal 33. The crank journal 33 is fitted in these recesses 110A and 120A of the upper and lower journal support walls 110 and 120. Further, a pair of front and rear journal bolts 131 and 132 are engaged into the crankcase 3 from its lower side to fasten the upper and lower journal support walls 110 and 120.

While the upper and lower journal support walls 110 and 120 corresponding to the left crank journal 33 are fastened together by using the journal bolts 131 and 132, the other upper and lower journal support walls 110 and 120 corresponding to the other crank journals 34 and 35 are also fastened together by using similar journal bolts 131 and 132.

That is, the three pairs of upper journal support walls 110 and lower journal support walls 120 for respectively supporting the three crank journals 33, 34, and 35 of the crankshaft 2 are formed between the upper crankcase half 111 and the lower crankcase half 121 so as to be spaced in the lateral direction of the engine 1 (i.e., in the lateral direction of the vehicle).

Further, as shown in FIG. 3, the lower crankcase half 121 is formed with a bearing portion 120B for supporting the counter shaft 60 (see FIG. 1) on the rear side of the recess 120A of the lower journal support wall 120.

Figure 4:
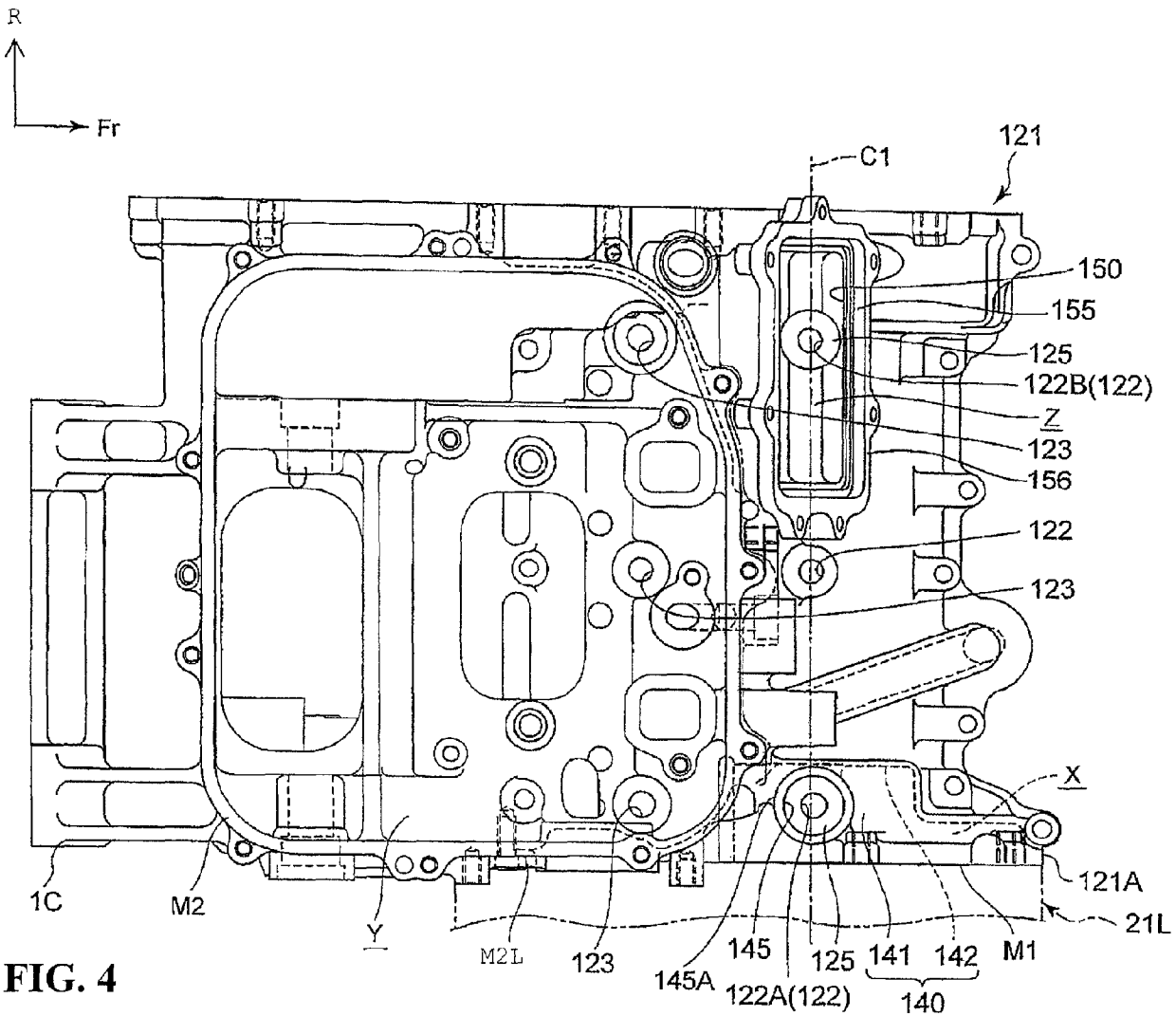
FIG. 4 is a bottom plan view of a lower crankcase half.

FIG. 4 is a bottom plan view of the lower crankcase half 121. As shown in FIG. 4, a plurality of bolt insertion holes 122 and 123 for insertion of the journal bolts 131 and 132 are exposed to the bottom surface of the lower crankcase half 121, so that the journal bolts 131 and 132 can be easily engaged and disengaged from the lower side of the crankcase 3.

After the oil lubricates a required portion of the engine 1 (e.g., a cylinder portion (i.e., the front and rear banks 4 and 5 in this preferred embodiment)), the oil is passed through a return oil passage (not shown) formed in the left crankcase side cover 21L (see FIG. 2).

In this case, if the oil from the crankcase side cover 21L is returned through the laterally outer side of the journal support walls 110 and 120 and the journal bolts 131 and 132 to the oil pan 10, so as to avoid interference with the journal support walls 110 and 120 and the journal bolts 131 and 132, the width of the oil pan 10 must be increased to cause an increase in size of the oil pan 10.

To cope with this problem, as shown in FIG. 3, a wall portion 140 for defining a space X as a flow passage for the return oil from the crankcase side cover 21L is formed below a journal bolt mounting surface 125 of the lower crankcase half 121, and this wall portion 140 is formed with a tool insertion hole 145 for insertion of a tool for tightening the journal bolt 131.

The wall portion 140 will now be described in more detail.

Figure 5:
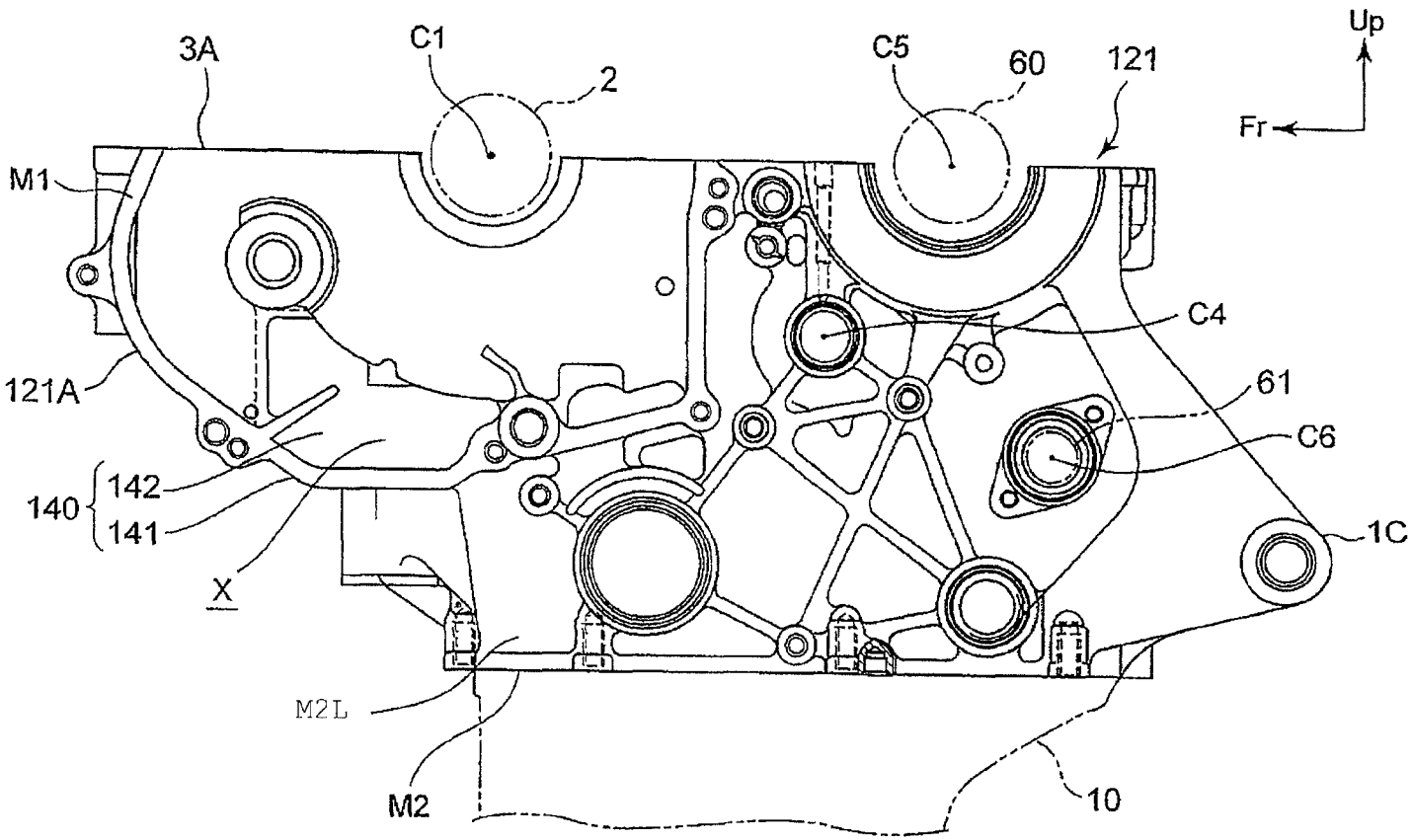
FIG. 5 is a left side view of the lower crankcase half.

FIG. 5 is a left side view of the lower crankcase half 121.

As shown in FIG. 3, the wall portion 140 projects downward from the front lower portion of the lower crankcase half 121 so as to define the space X below the journal bolt mounting surface 125 for mounting the front journal bolt 131 in the lower crankcase half 121. Further, as shown in FIG. 5, the space X defined by the wall portion 140 opens on the left side of the lower crankcase half 121 where the left crankcase side cover 21L is connected.

The wall portion 140 has a bottom wall 141 (see FIGS. 3 and 5) forming the bottom surface of the space X and a vertical wall 142 (see FIG. 4) forming a laterally inner surface (right surface) of the space X. The upper surface of the space X is formed by the journal bolt mounting surface 125.

The wall portion 140 is formed integrally with the lower crankcase half 121 in forming the lower crankcase half 121 by casting. As viewed in side elevation of the engine 1, the wall portion 140 is formed at a position above the oil filter 69 (see FIG. 1) located on the front side of the lower portion of the lower crankcase half 121. This position of the wall portion 140 is set behind the front engine mount 1A (see FIG. 1) and before the front surface of the oil pan 10. That is, the space X defined by the wall portion 140 is located before the front surface of the oil pan 10, above the oil filter 69, and behind the front engine mount 1A.

As viewed in left side elevation of the lower crankcase half 121 as shown in FIG. 5, the bottom wall 141 extends obliquely downwardly from the lower end of a front wall 121A of the lower crankcase half 121 and further extends substantially horizontally toward the rear side. The crankcase side cover 21L is connected to the end surface of the front wall 121A and the bottom wall 141.

In other words, the end surface of the front wall 121A and the bottom wall 141 functions as a mating surface M1 (see FIG. 5) for the crankcase side cover 21L. The exit of the return oil passage formed in the crankcase side cover 21L is in communication with the space X, thereby introducing the oil from the return oil passage into the space X.

As shown in FIG. 3, the bottom wall 141 is inclined downwardly toward the rear side in the vicinity of the journal bolt 131, and the rear portion of the bottom wall 141 is formed with a through hole (exit oil passage) 143 extending through the wall of the lower crankcase half 121 along the inclination of an upper surface 141A of the bottom wall 141.

The through hole 143 is located laterally inside of the mating surface M1 for the crankcase side cover 21L, and communicates with the space X and a space Y leading to the oil pan 10.

Accordingly, the return oil from the crankcase side cover 21L is introduced into the space X formed laterally inside of the mating surface M1 for the crankcase side cover 21L. Thereafter, the oil is returned from the space X through the through hole 143 formed laterally inside of the mating surface M1 to the oil pan 10.

In this case, the oil can be returned from the crankcase side cover 21L to the oil pan 10 without passing a portion laterally outside of the journal support walls 110 and 120 and the journal bolts 131 and 132. That is, the oil pan 10 can be located laterally inside of the space X.

Accordingly, the oil pan 10 can be located laterally inside of the mating surface M1 for the crankcase side cover 21L, so that the width of the oil pan 10 can be reduced.

In FIG. 4, a mating surface M2 of the lower crankcase half 121 for the oil pan 10 is provided. As shown in FIG. 4, the position of the left side M2L of the mating surface M2, i.e., the position of the left side surface of the oil pan 10 is set just laterally inside of the mating surface M1 for the crankcase side cover 21L. However, the lateral position of the left side surface of the oil pan 10 may be further retracted from the mating surface M1.

As shown in FIG. 3, the bottom wall 141 is formed with a cylindrical portion 145A extending downwardly at a position below the front journal bolt 131. The tool insertion hole 145 for insertion of the tool for tightening the journal bolt 131 is formed in the cylindrical portion 145A. More specifically, the tool insertion hole 145 is formed so as to allow the insertion of the journal bolt 131 and the insertion of the tool for tightening the journal bolt 131.

Further, a plug (not shown) is normally fitted in the cylindrical portion 145A (in any cases other than the case of disassembling the engine 1), thereby closing the tool insertion hole 145. For example, by forming internal threads in the cylindrical portion 145A, various general-purpose screw parts may be used as the above-mentioned plug.

As shown in FIG. 4, the vertical wall 142 functions as a partition wall for partitioning the inside space of the lower crankcase half 121 into the space X and the other space in the lateral direction of the engine 1.

The vertical wall 142 extends in the longitudinal direction of the engine 1 at a position laterally inside of the cylindrical portion 145A in the vicinity thereof, and the front end of the vertical wall 142 reaches the front wall 121A of the lower crankcase half 121.

Accordingly, the length of the space X in the longitudinal direction of the engine 1 can be made relatively large and the volume of the space X can therefore be enlarged.

Further, as shown in FIGS. 3 and 4, the bottom wall 141 extends in the longitudinal direction of the engine 1 so as to span the lower side of the cylindrical portion 145A, and the front end of the bottom wall 141 reaches the front wall 121A of the lower crankcase half 121. In other words, the space X ranges from the front wall 121A of the lower crankcase half 121 to the rear side of the cylindrical portion 145A in the longitudinal direction of the engine 1.

As described above, the space X ranges from the front wall 121A of the lower crankcase half 121 to the rear side of the cylindrical portion 145A in the longitudinal direction of the engine 1. Accordingly, the space X elongated in the longitudinal direction of the engine 1 can be formed without changing the longitudinal size of the lower crankcase half 121, thereby enlarging the volume of the space X.

Due to such a large volume of the space X, the momentum of the return oil flowing from the crankcase side cover 21L can be suppressed in the space X. Accordingly, the space X functions as a buffer for the return oil and it is also expected to have an effect of eliminating bubbles produced in the return oil.

As described above, the wall portion 140 for defining the space X as a flow passage for the return oil is formed below the journal bolt mounting surface 125 of the lower crankcase half 121, and the tool insertion hole 145 for insertion of a tool for tightening the journal bolt 131 is formed through the wall portion 140. Accordingly, the journal bolt 131 can be tightened from the lower side of the crankcase 3, and a return oil passage can be formed below the journal bolt mounting surface 125. This return oil passage is located laterally inside of the mating surface M1 for the crankcase side cover 21L, so that the width of the oil pan 10 in the lateral direction of the engine 1 can be reduced.

Further, as shown in FIGS. 3 to 5, the space X and the oil pan 10 are shifted in position from each other in the longitudinal direction of the engine 1, so that the length of the oil pan 10 in the longitudinal direction of the engine 1 can also be reduced. As a result, both the width and the length of the oil pan 10 can be reduced to thereby reduce the size of the oil pan 10.

As described above, the return oil passage (return passage for the lubricating oil) is formed below the journal bolt mounting surface 125. That is, the return oil passage can be formed without passing through the laterally outer side of the journal support walls 110 and 120 and the journal bolts 131 and 132. Accordingly, an increase in friction due to such bypassing can be prevented.

Thus, it is possible to prevent an increase in friction due to formation of a bypass oil passage, and it is also possible to prevent an increase in weight due to an increase in size of the oil pan 10.

Further, the return oil passage can be formed by utilizing a dead space below the journal bolt mounting surface 125. That is, the dead space can be effectively utilized. Further, it is unnecessary to increase the width of the lower crankcase half 121 in forming the return oil passage, so that an increase in width of the crankcase 3 can be prevented. Accordingly, the wall portion 140 for defining the space X as the return oil passage can be easily added to an existing lower crankcase half without such a wall portion 140 by design change.

As described above, the tool insertion hole 145 for insertion of the tool for tightening the journal bolt 131 is formed through the wall portion 140, and the tool insertion hole 145 is closed by a plug. Accordingly, a closing structure for the tool insertion hole 145 is simple, so that an increase in cost therefore can be minimized.

Further, the wall portion 140 is located laterally outside of the oil pan 10 of the engine (see FIG. 4), and the wall portion 140 is formed with the through hole (exit oil passage) 143 for discharging the return oil from the space X toward the oil pan 10 (see FIG. 3). Accordingly, the oil from the space X can be smoothly returned through the through hole 143 toward the oil pan 10.

As described above, the wall portion 140 defines the space X opening to the left side of the lower crankcase half 121, and the return oil from the crankcase side cover 21L connected to the left side of the lower crankcase half 121 flows into the space X through its left side opening. Accordingly, the size of the oil pan 10 can be sufficiently reduced in relation to the configuration for returning the oil from the crankcase side cover 21L to the oil pan 10.

As shown in FIG. 4, the wall portion 140 for defining the space X as the return oil passage is formed below the journal bolt mounting surface 125 (the mounting surface for the journal bolt 131 to be inserted into the left bolt insertion hole 122A) near the left crankcase side cover 21L. In addition, a wall portion 150 for defining a space as an oil passage is also formed below another journal bolt mounting surface 125 (the mounting surface for the journal bolt 131 to be inserted into the right bolt insertion hole 122B) near the right crankcase side cover 21R. Further, the wall portion 150 is formed with a vertically extending tool insertion hole 155.

Figure 6A:
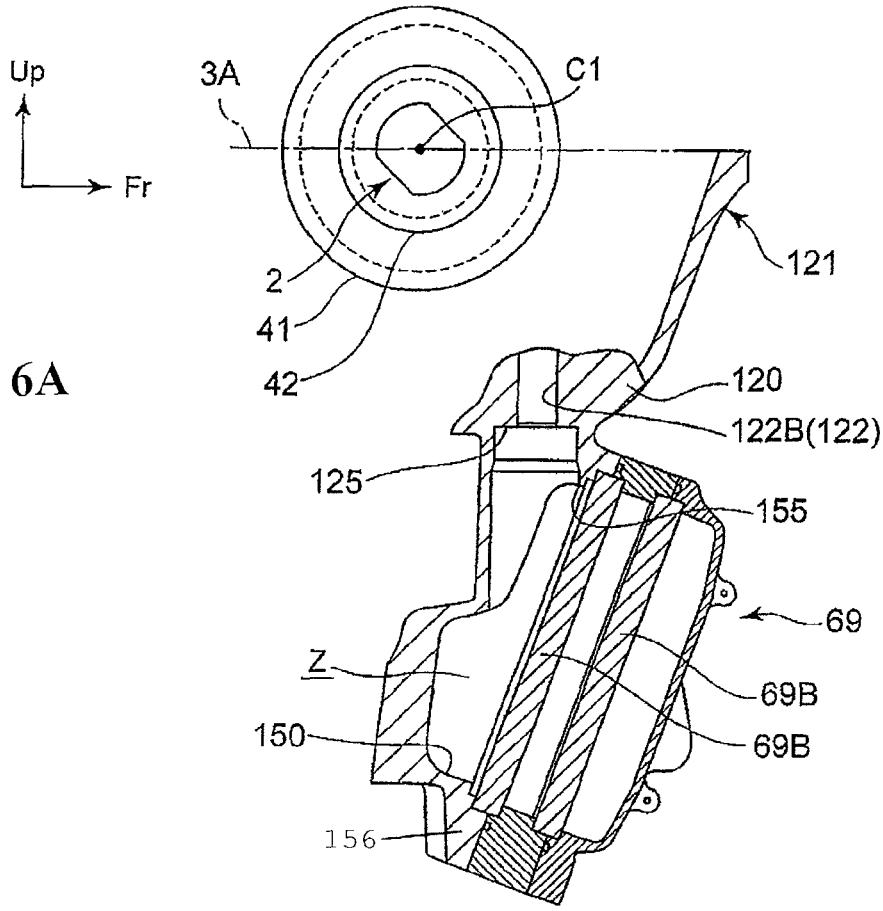
FIG. 6A is a sectional side view showing a bolt insertion hole and its periphery in the lower crankcase half.
Figure 6B:
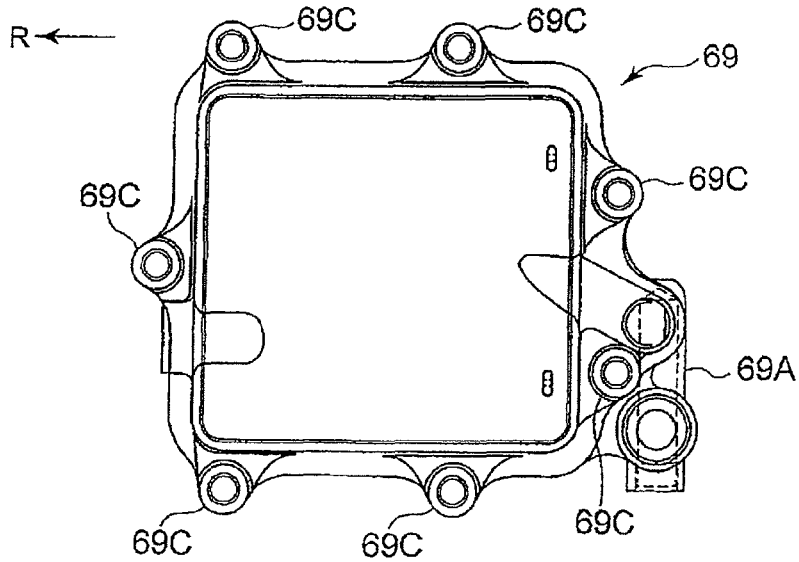
FIG. 6B is a front elevation of an oil filter.

FIG. 6A is a sectional side view showing the bolt insertion hole 122B and its periphery in the lower crankcase half 121, and FIG. 6B is a front elevation of the oil filter 69.

The wall portion 150 formed below the bolt insertion hole 122B defines a discharge oil space Z through which the discharge oil fed from the oil pump 68 is adapted to flow. As shown in FIG. 6A, the tool insertion hole 155 of the wall portion 150 is closed by the detachable oil filter 69. That is, the oil filter 69 constitutes a part of the wall portion 150 for defining the discharge oil space Z below the journal bolt mounting surface 125.

As shown in FIG. 6B, an oil inset port 69A is formed on one side surface (left side surface) of the oil filter 69. As shown in FIG. 6A, two filter cartridges 69B are arranged in the form of two layers in the oil filter 69. The oil from the oil pump 68 is supplied through the oil inlet port 69A into the oil filter 69 and next passed through the filter cartridges 69B. The oil cleaned by the filter cartridges 69B is supplied to the discharge oil space Z defined by the wall portion 150 and next fed to the required portions to be lubricated in the engine 1.

Thus, the discharge oil passage (discharge passage for the lubricating oil) is also formed by utilizing a dead space below the journal bolt mounting surface 125 on the right side of the engine 1. That is, as described above, the return oil passage is formed by utilizing the dead space below the journal bolt mounting surface 125 on the left side of the engine 1. Accordingly, the oil pan 10 can be shifted in position from the space X toward the rear side, thereby reducing the length of the oil pan 10 in the longitudinal direction of the engine 1. Since the oil pan 10 is shifted in position toward the rear side, a dead space is also formed below the right journal bolt mounting surface 125 on the front side of the oil pan 10, and this dead space is utilized to form the discharge oil passage.

Accordingly, the discharge oil passage passing through the oil filter 69 can be formed without bypassing the journal support walls 110 and 120 and the journal bolts 131 and 132. As a result, a friction can be reduced and it is unnecessary to avoid the mounting position of the journal bolt 131 in mounting the oil filter 69. Accordingly, the flexibility to layout and shape of the oil filter 69 can be improved.

As shown in FIG. 6A, the tool insertion hole 155 has a substantially rectangular opening directed obliquely downward toward the front side of the vehicle. A rectangular frame like filter mounting portion 156 projects frontward from the periphery of the front opening of the tool insertion hole 155, and the oil filter 69 is mounted on the filter mounting portion 156 by means of a plurality of bolts (not shown). Accordingly, the oil filter 69 is connected to the lower crankcase half 121 so as to close the tool insertion hole 155.

As shown in FIG. 6A, the lower end of the bolt insertion hole 122B opens to the tool insertion hole 155, so that the journal bolt 131 and a bolt tightening tool can be easily applied to the bolt insertion hole 122B. Further, the oil filter 69 can be mounted on the front surface of the lower crankcase half 121 so as to be raised substantially vertically, thereby reducing the length of the lower portion of the engine 1 including the oil filter 69 in the longitudinal direction of the engine 1.

In FIG. 6B, a plurality of bolt inserting portions 69C are spaced from each other along the periphery of the oil filter 69. The oil filter 69 is connected to the lower crankcase half 121 by means of the bolts inserted into the bolt inserting portions 69C.

Having thus described a specific preferred embodiment of the present invention, it should be noted that the present invention is not limited to this preferred embodiment. For example, while the present invention is applied to a water-cooled, four-stroke, V-type, four-cylinder engine in this preferred embodiment, the present invention may be applied to any other types of internal combustion engines.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A crankcase of an internal combustion engine includes an upper crankcase half and a lower crankcase half, said upper crankcase half and said lower crankcase half respectively having an upper journal support wall and a lower journal support wall for cooperatively supporting a crank journal of a crankshaft, said upper journal support wall and said lower journal support wall being fastened together by a journal bolt mounted from a lower side of said crankcase, comprising:

a wall portion for defining a space as a flow passage for a lubricating oil is formed below a journal bolt mounting surface of said lower crankcase half for mounting said journal bolt; and a tool insertion hole for insertion of a tool for tightening said journal bolt is formed through said wall portion, wherein said wall portion is located laterally outside of an oil pan of said internal combustion engine; and said wall portion is formed with an exit oil passage for discharging said lubricating oil from said space toward said oil pan.

2. The crankcase of an internal combustion engine according to claim 1, wherein:

said space defined by said wall portion opens to one lateral side of said lower crankcase half;

a side cover is connected to said one lateral side of said lower crankcase half; and said lubricating oil returned from said side cover flows into said space through its side opening.

3. The crankcase of an internal combustion engine according to claim 1, wherein said wall portion comprises a detachable oil filter.

4. The crankcase of an internal combustion engine according to claim 1, wherein the wall portion projects downwardly from a front lower portion of the lower crankcase half and opens to a left side of the lower crankcase half where a left crankcase side cover is connected.

5. The crankcase of an internal combustion engine according to claim 4, wherein the wall portion includes a bottom wall forming a bottom surface of the space and a vertical wall forming a laterally inner surface of the space with an upper surface of the space being formed by a journal bolt mounting surface.

6. The crankcase of an internal combustion engine according to claim 5, wherein return oil from left crankcase side cover is introduced into the space formed laterally inside a mating surface of the crankcase side cover wherein oil is returned from the space through the exit oil passage to the oil pan.

7. The crankcase of an internal combustion engine according to claim 6, wherein oil is returned from the crankcase side cover to the oil pan without passing a portion laterally outside of the upper journal support wall and the lower journal support wall, wherein the oil pan is located laterally inside the space.

8. The crankcase of an internal combustion engine according to claim 7, wherein the oil pan is located laterally inside a mating surface of the left crankcase side cover wherein a width of the oil pan is reduced.

9. The crankcase of an internal combustion engine according to claim 1, wherein the wall portion is formed integrally with the lower crankcase half at a position above an oil filter located on a front side of the lower portion of the lower crankcase half.

10. A crankcase of an internal combustion engine comprising:

an upper crankcase half;

a lower crankcase half;

an upper journal support wall being formed in said upper crankcase half;

a lower journal support wall being formed in said lower crankcase;

said upper journal support wall and said lower journal support wall being operatively positioned for cooperatively supporting a crank journal of a crankshaft;

at least one journal bolt for fastening together said upper journal support wall and said lower journal support wall; said at least one journal bolt being mounted from a lower side of said crankcase;

a wall portion for defining a space as a flow passage for a lubricating oil, said wall portion being formed below a journal bolt mounting surface of said lower crankcase half for mounting said journal bolt; and a tool insertion hole for insertion of a tool for tightening said journal bolt, said tool insertion hole being formed through said wall portion, wherein said wall portion is located laterally outside of an oil pan of said internal combustion engine; and said wall portion is formed with an exit oil passage for discharging said lubricating oil from said space toward said oil pan.

11. The crankcase of an internal combustion engine according to claim 10, wherein:

said space defined by said wall portion opens to one lateral side of said lower crankcase half;

a side cover is connected to said one lateral side of said lower crankcase half; and said lubricating oil returned from said side cover flows into said space through its side opening.

12. The crankcase of an internal combustion engine according to claim 10, wherein said wall portion comprises a detachable oil filter.

13. The crankcase of an internal combustion engine according to claim 10, wherein the wall portion projects downwardly from a front lower portion of the lower crankcase half and opens to a left side of the lower crankcase half where a left crankcase side cover is connected.

14. The crankcase of an internal combustion engine according to claim 13, wherein the wall portion includes a bottom wall forming a bottom surface of the space and a vertical wall forming a laterally inner surface of the space with an upper surface of the space being formed by a journal bolt mounting surface.

15. The crankcase of an internal combustion engine according to claim 14, wherein return oil from left crankcase side cover is introduced into the space formed laterally inside a mating surface of the crankcase side cover wherein oil is returned from the space through the exit oil passage to the oil pan.

16. The crankcase of an internal combustion engine according to claim 15, wherein oil is returned from the crankcase side cover to the oil pan without passing a portion laterally outside of the upper journal support wall and the lower journal support wall, wherein the oil pan is located laterally inside the space.

17. The crankcase of an internal combustion engine according to claim 16, wherein the oil pan is located laterally inside a mating surface of the left crankcase side cover wherein a width of the oil pan is reduced.

18. The crankcase of an internal combustion engine according to claim 10, wherein the wall portion is formed integrally with the lower crankcase half at a position above an oil filter located on a front side of the lower portion of the lower crankcase half.

19. A crankcase of an internal combustion engine includes an upper crankcase half and a lower crankcase half, said upper crankcase half and said lower crankcase half respectively having an upper journal support wall and a lower journal support wall for cooperatively supporting a crank journal of a crankshaft, said upper journal support wall and said lower journal support wall being fastened together by a journal bolt which is mounted from a lower side of said crankcase and extends vertically upward, comprising:

a wall portion for defining a space as a flow passage for a lubricating oil is formed below a journal bolt mounting surface of said lower crankcase half for mounting said journal bolt; and a tool insertion hole for insertion of a tool for tightening said journal bolt is formed through said wall portion, wherein said wall portion and said tool insertion hole are located forwardly and outside of an oil pan of said internal combustion engine.

20. The crankcase of an internal combustion engine according to claim 19, wherein said wall portion is formed with an exit oil passage for discharging said lubricating oil from said space toward said oil pan.

* * * * *